US010516234B2

(12) United States Patent
Nagayama et al.

(10) Patent No.: US 10,516,234 B2
(45) Date of Patent: Dec. 24, 2019

(54) CONNECTOR UNIT INCLUDING CONNECTOR COVER HAVING NOTCH PARTS

(71) Applicants: YAZAKI CORPORATION, Tokyo (JP); AISIN AW CO., LTD., Aichi (JP)

(72) Inventors: Masataka Nagayama, Shizuoka (JP); Kenji Takahashi, Shizuoka (JP); Masayuki Yamamoto, Shizuoka (JP); Teruo Kato, Aichi (JP); Yusuke Hinoda, Aichi (JP)

(73) Assignees: YAZAKI CORPORATION, Tokyo (JP); AISIN AW CO., LTD., Aichi-ken (JP)

( * ) Notice: Subject to any disclaimer, the term of this patent is extended or adjusted under 35 U.S.C. 154(b) by 0 days.

(21) Appl. No.: 16/074,771

(22) PCT Filed: Feb. 8, 2017

(86) PCT No.: PCT/JP2017/004549
§ 371 (c)(1),
(2) Date: Jun. 12, 2019

(87) PCT Pub. No.: WO2017/138556
PCT Pub. Date: Aug. 17, 2017

(65) Prior Publication Data

US 2019/0052013 A1 Feb. 14, 2019

(30) Foreign Application Priority Data

Feb. 9, 2016 (JP) ..... 2016-022909

(51) Int. Cl.
*H01R 13/58* (2006.01)
*H01R 13/506* (2006.01)
(Continued)

(52) U.S. Cl.
CPC ..... *H01R 13/5825* (2013.01); *H01R 13/506* (2013.01); *H01R 13/567* (2013.01);
(Continued)

(58) Field of Classification Search
CPC ..... H01R 13/5825; H01R 13/5841
See application file for complete search history.

(56) References Cited

U.S. PATENT DOCUMENTS 9,130,283 B1 * 9/2015 Lin ..... H01R 13/5841
9,698,552 B2 * 7/2017 Kitamura ..... H01R 13/506
(Continued)

FOREIGN PATENT DOCUMENTS

CN 2669413 Y 1/2005
CN 202076527 U 12/2011
(Continued)

OTHER PUBLICATIONS

English language Written Opinion of the International Search Report for PCT/JP2017/004549 dated Mar. 7, 2017.
(Continued)

*Primary Examiner* — Tho D Ta
(74) *Attorney, Agent, or Firm* — Kenealy Vaidya LLP

(57) ABSTRACT

A connector unit including a connector and a connector cover. Locking protrusions are provided at one end of the connector, and locking holes are provided in an upper wall and a bottom wall of the connector cover. Notch parts capable of receiving the electric wire are provided at any one end of both ends of the upper wall and both ends of the bottom wall corresponding to both opening ends of the hollow space surrounded by the connector, the upper wall, the bottom wall, and side walls.

3 Claims, 6 Drawing Sheets

(51) Int. Cl.
*H01R 13/56* (2006.01)
*H01R 25/00* (2006.01)

(52) U.S. Cl.
CPC ..... *H01R 25/003* (2013.01); *H01R 13/5841* (2013.01); *H01R 2201/26* (2013.01)

(56) References Cited

U.S. PATENT DOCUMENTS

| | | | | |
|---|---|---|---|---|
| 10,211,566 | B2 * | 2/2019 | Nagayama ..... | H01R 13/506 |
| 2014/0242819 | A1 | 8/2014 | Suzuki | |
| 2014/0242820 | A1 | 8/2014 | Suzuki | |
| 2014/0242821 | A1 | 8/2014 | Suzuki | |
| 2014/0242822 | A1 | 8/2014 | Suzuki | |
| 2016/0190755 | A1 | 6/2016 | Kitamura et al. | |
| 2016/0322741 | A1 | 11/2016 | Nagayama et al. | |
| 2017/0279218 | A1 | 9/2017 | Nagayama et al. | |

FOREIGN PATENT DOCUMENTS

| | | | |
|---|---|---|---|
| CN | 104009313 | A | 8/2014 |
| JP | 2015-35391 | A | 2/2015 |
| JP | 2015-103312 | A | 6/2015 |
| JP | 2015-103314 | A | 6/2015 |

OTHER PUBLICATIONS

International Search Report and Written Opinion of the International Search Report for PCT/JP2017/004549 dated Mar. 7, 2017.
Japanese Office Action for the related Japanese Patent Application No. 2016-022909 dated May 8, 2018.
Chinese Office Action for the related Chinese Patent Application No. 201780009612.9 dated Apr. 10, 2019.

* cited by examiner

CONNECTOR UNIT INCLUDING CONNECTOR COVER HAVING NOTCH PARTS

TECHNICAL FIELD

The present invention relates to a connector unit which is used in a vehicle to route an electric wire.

BACKGROUND ART

In a vehicle, an electric wire is routed which transmits power from a battery or a control signal from a control device, to an electronic device. When the electric wire is routed, it is necessary to regulate a routing path where the electric wire is routed and to protect the electric wire for preventing damage of the electric wire. As a few examples, FIGS. 5 to 10 illustrate a connector unit in the related art and an aspect where the electric wire is routed by using the connector unit (for example, see Patent Literatures 1 and 2).

As illustrated in FIGS. 5 and 6, a connector unit 30 includes a female connector 20 assembled to a male connector (not illustrated) and a connector cover 10 assembled to the female connector 20. The detailed description will be given below with reference to FIGS. 8 and 9, and the connector cover 10 includes a lock part (an engaging piece 50 and a locking hole 15) which is a locking mechanism between an upper wall 13 and a bottom wall 14 and the female connector 20, and is accommodated in a base such as a transmission case (not illustrated).

Further, the description will be given about the connector cover 10. FIGS. 8 and 9 specifically illustrate the configuration of the female connector 20 and the connector cover 10 of the connector unit in the related art. As illustrated in FIGS. 8 and 9, in the connector cover 10, the space sandwiched by the upper wall 13 and the bottom wall 14 functions as an electric wire insertion port 17 into which the electric wire 80 is inserted. In the electric wire insertion port 17, the electric wire 80 is inserted along a width direction (a backward and forward direction of FIG. 9) of the connector cover 10. Further, in a partial electric wire of the electric wire 80, a terminal provided in the tip of the partial electric wire which is directed toward the female connector 20 in which the connector cover 10 is assembled is accommodated in the terminal accommodating chamber of the female connector 20. On the other hand, the other electric wire of the electric wire 80 which is not directed toward the female connector 20 passes through the electric wire insertion port 17 toward the adjacent connector unit 30. Thus, a plurality of the female connectors 20 in which the electric wire is assembled are fitted separately in the male connector. In this manner, by using the connector unit 30, the path in which the electric wire 80 is routed is formed in a direction in which the adjacent electric wire insertion ports 17 of the connector cover 10 are arranged. Thus, the electric wire can be aggregated and routed by the connector cover 10. Further, since the direction in which the connector cover 10 is attached in the female connector 20 is the same as the direction in which he female connector 20 is fitted in the male connector, it can be also prevented that when the female connector 20 is fitted in the male connector, for example, the connector cover 10 is erroneously deviated from the female connector 20, resulting in reduction of the efficiency of the fitting operation.

In the routed state illustrated in FIGS. 5 and 6, the routing path can be regulated by the connector cover 10, and thus an operation of binding the electric wire with a binding band or the like can be omitted. Further, since the electric wire 80 is drawn via the connector cover 10, even in a case where a tension force acts on the electric wire 80, the tension force acts on the connector cover 10 first, and thus the force hardly acts on the terminal accommodated in the terminal accommodating chamber of the female connector 20, which is advantageous.

As illustrated in FIG. 8. In the female connector 20, the locking protrusion 24 is formed in the tip positioned on a side of the connector cover 10. In detail, the female connector 20 has a box shape as a whole, and the four corners positioned on the side of the connector cover 10 are formed with the locking protrusions 24. On the other hand, the engaging piece 50 is protrudingly formed in the tip which is positioned on a side of the female connector 20 of the connector cover 10. In detail, in the connector cover 10, the upper wall 13 and the bottom wall 14 are separated to such an extent that the tip positioned on the side of the connector cover 10 of the female connector 20 can be accommodated. The engaging piece 50 is positioned to face the locking protrusion 24 which is positioned in the tip of the female connector 20 accommodated in the upper wall 13 and the bottom wall 14. In the engaging piece 50, the locking hole 15 is formed, and the connector cover 10 is locked in the female connector 20 by the engagement between the locking hole 15 and the locking protrusion 24.

Further, as another the related art different from the connector unit, a connector is disclosed which has a shape of retracting in the direction to avoid the interference with the aligned electric wire in a case where the housing of the connector is displaced, that is, which is provided with a first tilted surface and a second tilted surface in the housing, and release parts, which avoids the interference with the electric wire, on both side edges (for example, see Patent Literature 3).

CITATION LIST

Patent Literature

[Patent Literature 1]: JP-A 2015-103312
[Patent Literature 2]: JP-A 2015-103314
[Patent Literature 3]: JP-A 2015-35391

SUMMARY OF THE INVENTION

Technical Problem

In the connector unit of the related art illustrated in FIGS. 5, 6, 8, and 9, when an assembling operation is performed which fits the female connector 20 attached with the connector cover 10 to the male connector, as illustrated in FIG. 7, the connector cover 10 is tilted in a rolling direction (a rotating direction having the direction in which the connector cover 10 is attached in the female connector 20 as an axis), and the connector cover 10 may be twisted and displaced with respect to the female connector 20. The above-described situation may occur in a case where a plurality of male connectors are mounted in the state of rotating by a predetermined angle with the direction in which the female connector 20 is fitted set as an axis and the female connector 20 is fitted in the male connector. The twist and displacement will be described below in detail.

FIG. 7 illustrates a state where the connector cover 10 and the female connector 20 are assembled with respect to the male connector mounted in the state of rotating by a predetermined angle. In the example of FIG. 7, a state is illustrated in which the connector cover 10 and the female connector 20 are tilted by an angle α with respect to a vertical direction H (in the other words, an upper and lower direction in FIG. 7) to be assembled. When the connector cover 10 and the female connector 20 rotate by the angle α with respect to the vertical direction H as above, the routing path of the electric wire 80 also is rotated by the angle α by the electric wire insertion port 17 of the connector cover 10. As a result, the electric wire 80 regulated by the electric wire insertion port 17 has a rippling shape in which a corrugated shape is repeated as illustrated in FIG. 7.

At that time, the connector cover 10 which acts on the electric wire 80 to regulate the path of the electric wire 80 receives a reaction from the electric wire 80 naturally. As a result, the connector cover 10 is twisted and displaced with respect to the female connector 20 which is fitted in the male connector to be fixed in the male connector. The twist and displacement with respect to the female connector 20 of the connector cover 10 increase as the number of the electric wires 80 inserted into the electric wire insertion port 17 increases. Incidentally, the female connector 20 is also twisted and displaced due to the twist and displacement of the connector cover 10.

As described above, when the connector cover 10 receives the action from the electric wire 80 to be twisted and displaced with respect to the female connector 20, the stress concentrates on any one or plural engaging margins of the locking protrusions 24 positioned in the four corners of the female connector 20 and the locking holes 15 positioned in the four corners of the connector cover 10. As a result, an excessive stress acts on the locking protrusion 24 or the locking hole 15 to impose a burden thereon or to cause deformation.

Specifically, as the connector cover 10 into which the electric wire 80 having the corrugated shape is inserted is illustrated in FIGS. 8 to 10, in a force point R in which the inner edge of the electric wire insertion port 17 of the rotated connector cover 10 is in contact with the electric wire 80, the connector cover 10 receives the stress from the electric wire 80. However, at that time, in the locking protrusion 24 and the locking hole 15 (the locking protrusion 24 and the locking hole 15 positioned on the right upper side of the connector cover 10 in FIG. 10) which are positioned to be the closest to the force point R, the excessive stress acts on the engaging margin. Further, when the entire connector cover 10 is twisted and displaced, the excessive stress also acts on the engaging margin of the locking protrusion 24 and the locking hole 15 (the locking protrusion 24 and the locking hole 15 positioned on the left lower side of the connector cover 10 in FIG. 10) which are positioned to be the farthest from the force point R.

The connector described in Patent Literature 3 has a configuration in which the housing and a cover part are integrated or are integrated by fitting protrusion parts to each other as illustrated in FIG. 3 of Patent Literature 3. For this reason, the fitting part of the housing and the cover part is solid, and additionally, although the stress is applied from the electric wire to the cover part, it is prevented that the stress causes the deformation of the housing and the cover part.

As understood from the above description, inconvenience such as deformation due to a load on the connector cover from the electric wire can occur irrespective of whether the connector cover is mounted to a female connector or a male connector.

The invention has been made in consideration of the above situation, and an object thereof is to provide a connector unit capable of preventing deformation of an engaging part between the connector and the connector cover due to a stress applied to the connector cover from the electric wire.

Solution to Problem

In order to achieve the object, the connector unit according to the invention is characterized as the following (1) to (3).

(1) A connector unit including:

a connector; and a connector cover mounted to one end of the connector, wherein the connector is capable of holding an electric wire so as to extend from the one end and includes a locking part at the one end, wherein the connector cover includes an upper wall and a bottom wall that sandwich the one end of the connector and that have a locked part engaged with the locking part at a position corresponding to the locking part and side walls connecting the upper wall and the bottom wall, and forms a hollow space surrounded by the connector, the upper wall, the bottom wall, and the side walls when being mounted to the connector, and wherein the connector cover includes notch parts capable of receiving the electric wire at any one end of both ends of the upper wall and both ends of the bottom wall corresponding to both opening ends of the hollow space.

(2) The connector unit according to (1), wherein the notch parts are formed at one position corresponding to one opening end of the hollow space out of the both ends of the upper wall and one position corresponding to the other opening end of the hollow space out of the both ends of the bottom wall.

(3) The connector unit according to (1), wherein the notch parts are formed at the both ends of the upper wall and the both ends of the bottom wall.

According to the connector unit having the configurations (1) to (3), the electric wire enters the notch part, so as to suppress that the electric wire interferes with the inner edge of the upper wall or the bottom wall of the connector cover. Even if there is interference, the interference of the inner edge of the upper wall or the bottom wall with respect to the electric wire is little. For this reason, the stress which the connector cover receives from the electric wire is lessened. As a result, the stress which concentrates on the engaging margin between the locking protrusion and the locking hole is lessened to prevent the deformation of the locking hole or the locking protrusion.

Advantageous Effects of the Invention

According to the invention, the stress which the connector cover receives from the electric wire is lessened. As a result, the stress which concentrates on the engaging margin between the locking protrusion and the locking hole is lessened to prevent the deformation of the locking hole or the locking protrusion.

Hereinbefore, the invention has been described simply. Further, an embodiment carried out to implement the invention (hereinafter, referred to as an embodiment.) will be described with reference to the drawings, and the detail of the invention will be further clarified.

DESCRIPTION OF EMBODIMENT

Hereinafter, one embodiment of the invention will be described with reference to FIGS. 1 to 4.

Figure 1:
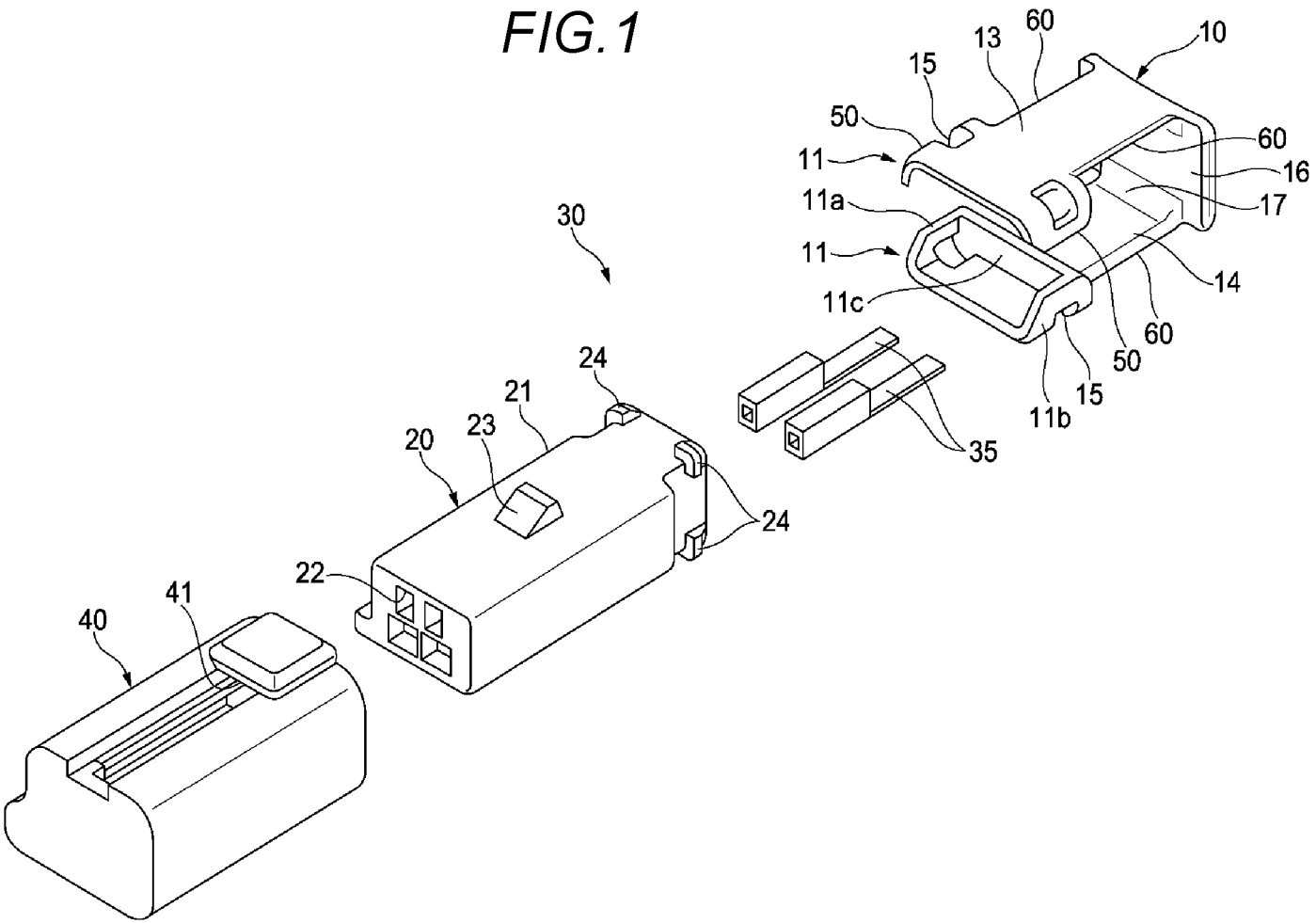
FIG. 1 is an exploded perspective view of a connector unit according to an embodiment of the invention.
Figure 2:
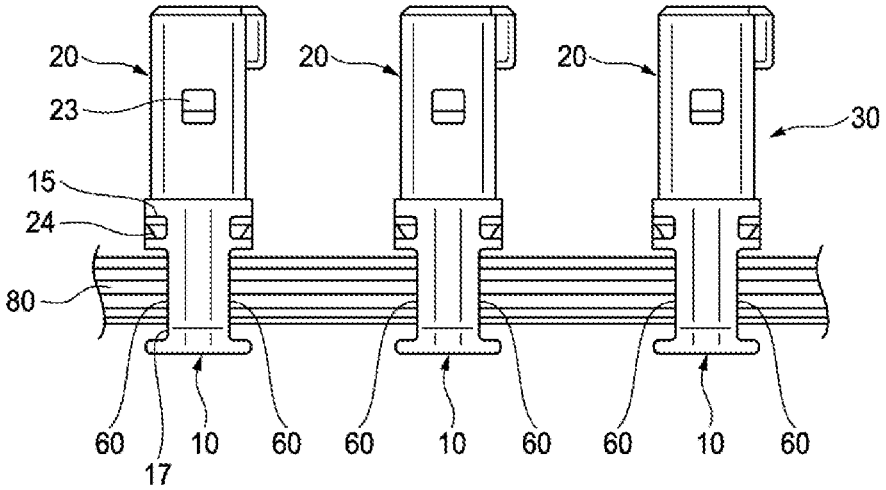
FIG. 2 is a plan view illustrating a usage state of the connector unit according to the embodiment of the invention.
Figure 3:
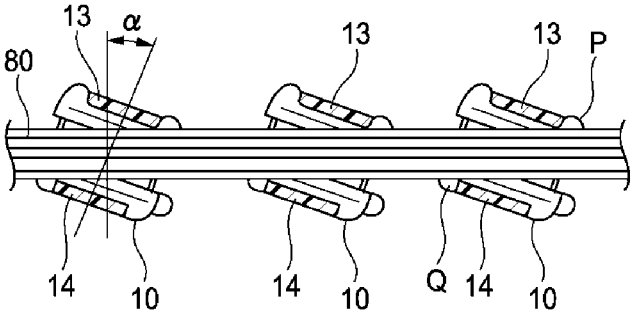
FIG. 3 is a sectional view of a connector cover part in a case where the connector unit according to the embodiment of the invention is rotated in a rolling direction.
Figure 4:
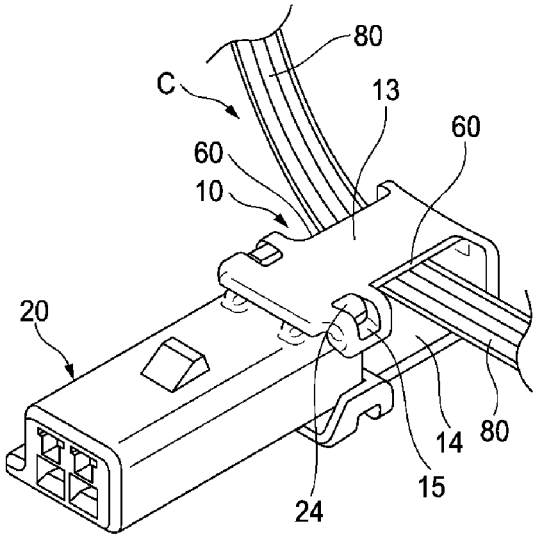
FIG. 4 is a perspective view of an electric wire routing state of the connector unit according to the embodiment.
Figure 5:
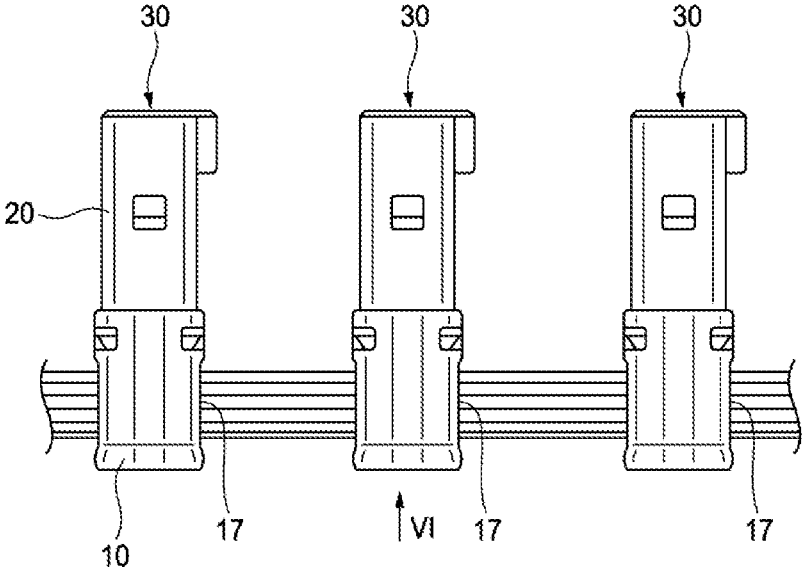
FIG. 5 is a plan view illustrating a usage state of a connector unit in the related art.
Figure 6:
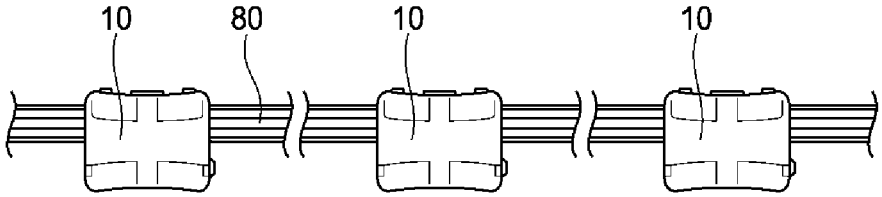
FIG. 6 is a side view of FIG. 5 when viewed in a VI direction.

FIG. 1 is an exploded perspective view of a connector unit according to an embodiment of the invention. FIG. 2 is a plan view illustrating a usage state of the connector unit according to the embodiment of the invention. FIG. 3 is a sectional view of the connector cover in a case where the connector unit according to the embodiment of the invention is rotated in the rolling direction. FIG. 4 is a perspective view of an electric wire routing state of the connector unit according to the embodiment. Hereinafter, in the connector unit according to the embodiment of the invention which will be described with reference to FIGS. 1 to 4, the same members as in the connector unit of the related art which has been described with reference to FIGS. 5 to 10 are denoted by the same reference numerals.

As illustrated in FIGS. 1 and 2, a connector unit 30 includes a female connector 20 attached in a male connector 40 and a connector cover 10 fitted in the female connector 20. All the members are formed of synthetic resin.

The female connector 20 includes a box-shaped housing 21 which is formed with a plurality of terminal accommodating chambers 22 therein. In each of the terminal accommodating chambers 22, one terminal 35 is accommodated. The female connector 20 has a box shape as a whole, and an engaging convex part 23 to be engaged in an engaging recess part 41 of the male connector 40 is provided in the top surface of the housing 21. The female connector 20 and the male connector 40 are locked by engaging the engaging convex part 23 and the engaging recess part 41 at the time of fitting. A plurality of male terminals (not illustrated) electrically connected with the terminal 35 are accommodated in the male connector 40. When the female connector 20 and the male connector 40 are fitted, both terminals are connected electrically. The electric wire 80 which extends from the terminal 35 is drawn from one end which is positioned on the side of the connector cover 10 of the housing 21. In other words, the female connector 20 can hold the electric wire 80 so as to extend from one end side.

In the female connector 20, a locking protrusion 24 (a locking part) is formed in the tip (in other words, one end side described above) positioned on the side of the connector cover 10. In detail, in the box-shaped housing 21, the locking protrusions 24 engaged in the locking holes 15 (locked part) of the connector cover 10 are formed in four corners positioned on the side of the connector cover 10 to protrude from the outer surface of the housing. The locking protrusion 24 is formed in each of four corners to have the same shape. The tip side provided with the locking protrusion 24 in the housing 21 has a symmetrical shape in a vertical direction (an upper and lower direction in FIG. 1). Similarly, the connector cover 10 also has a symmetrical shape in the vertical direction. Thus, it is not necessary to give concern about the upper and lower side of the connector cover 10 when the connector cover 10 is assembled in the housing 21.

As illustrated in FIG. 1, the connector cover 10 includes an upper wall 13, a bottom wall 14, and a side wall 16 connecting the upper wall 13 and the bottom wall 14. A portion of the upper wall 13 and the bottom wall 14 portion positioned on the side of the female connector 20 is formed as a fitting part 11. When the connector cover 10 is assembled with the female connector 20, a portion of the housing 21 which includes the locking protrusion 24 and is positioned on the tip side (one end side) is accommodated in the fitting part 11. In other words, the connector cover 10 includes the upper wall 13 and the bottom wall 14 that sandwich one end of the female connector 20. The fitting part 11 includes a horizontal plate part 11*c* which is a wall surface erecting from the upper wall 13 and the bottom wall 14 to extend in the width direction of the connector cover 10, and both side plate parts 11*a* and 11*b* which are wall surfaces which are provided in both end portions of the horizontal plate part 11*c* to be separated to have almost the same inner width dimension as the width dimension of the tip of the housing 21. The side of the fitting part 11 which faces the female connector 20 is opened. Further, the both side plate parts 11*a* and 11*b* are provided with a through hole formed in the corner part formed between the upper wall 13 and the bottom wall 14 and is provided with the locking hole 15 to be engaged with the above-described locking protrusion 24. In other words, the upper wall 13 and the bottom wall 14 include the locking hole 15 engaged with the locking protrusion 24 at a position corresponding to the locking protrusion 24. Further, a space is formed between the horizontal plate part 11*c* and the side wall 16. The space functions as an electric wire insertion port 17. The electric wire insertion port 17 is formed by opening both sides of the connector cover 10 in the width direction, and the electric wire 80 is inserted thereinto so that the electric wire 80 is accommodated therein. In other words, when being mounted to the female connector 20, the connector cover 10 forms a hollow space (electric wire insertion port 17) surrounded by the female connector 20, the upper wall 13, the bottom wall 14, and the side wall 16.

Particularly, as illustrated in FIG. 1, a notch part 60 for avoiding the interference with the electric wire 60 is formed on both sides of the upper wall 13 and the bottom wall 14 in the width direction. In other words, the connector cover 10 includes the notch parts 60 capable of receiving the electric wire 80 at both ends of the upper wall 13 corresponding to both opening ends of the hollow space (electric wire insertion port 17) and both ends of the bottom wall 14. In this example, the notch parts 60 are provided at both ends of the upper wall 13 and both ends of the bottom wall 14 (total of four positions), but the notch parts 60 may be provided in at least one end of both ends of the upper wall 13 and both ends of the bottom wall 14. For example, the notch parts 60 may be provided at either one of both ends of the upper wall 13 and both ends of the bottom wall 14. Further, for example, the notch parts 60 may be provided (that is, diagonally) at one position corresponding to one opening end of the hollow space (electric wire insertion port 17) out of both ends of the upper wall 13 and one position corresponding to the other opening end of the hollow space (electric wire insertion port 17) out of both ends of the bottom wall 14. Due to such notch parts 60, the width dimension in the electric wire insertion port 17 of the upper wall 13 and the bottom wall 14 becomes smaller than the width dimension (that is, the outer widths of both side plate parts 11*a* and 11*b*) of the fitting part 11.

Hereinbefore, the detail description will be given about the structure of the connector cover 10 and the female connector 20 configuring the connector unit 30. When the connector cover 10 and the female connector 20 are assembled, first, each of the plural terminals 35 provided in the electric wire 80 is inserted into a predetermined terminal accommodating chamber 22 in a predetermined female connector 20. Thereafter, the connector cover 10 is assembled with the female connector 20 into which all the necessary terminals 35 are inserted. At that time, when the fitting part 11 of the connector cover 10 is mounted in the tip positioned on the side of the connector cover 10 of the housing 21, the locking hole 15 of the connector cover 10 is engaged with the locking protrusion 24 of the female connector 20, and the connector cover 10 is locked in the female connector 20. The assembly of the connector cover 10 is performed with respect to all the female connectors which need to be assembled, thereby completing a series of assembly.

Thus, as illustrated in FIG. 2, the connector unit 30 in which the connector cover 10 is assembled with the female connector 20 is completed. As described above, according to the connector unit 30, the female connector 20 is fitted in the male connector fixed in a base (not illustrated) or the like. In the connector unit 30 of the embodiment of the invention, the electric wire can be aggregated and routed by the connector cover 10. Further, since the direction in which the connector cover 10 is attached in the female connector 20 is the same as the direction in which the female connector 20 is fitted in the male connector, it can be also prevented that when the female connector 20 is fitted in the male connector, for example, the connector cover 10 is erroneously deviated from the female connector 20 so as to reduce the efficiency of the fitting operation.

Incidentally, if the notch part 60 is not formed in the connector cover 10, when the electric wire 80 contacts the upper wall 13 or the bottom wall 14 and the connector cover 10 is twisted and displaced with respect to the female connector 20, the stress concentrates on any one or a plurality of (for example, two positioned diagonally) engaging margins of the locking protrusions 24 positioned in the four corners of the female connector 20 and the locking holes 15 positioned in the four corners of the connector cover 10, and a load can be applied onto the locking protrusion 24 or the locking hole 15.

However, according to the connector unit 30, since the notch part 60 is formed in the connector cover 10, even when the connector cover 10 and the female connector 20 are rotated by the angle α with respect to the vertical direction H as illustrated in FIG. 3, the electric wire 80 enters the notch part 60, whereby the electric wire 80 is prevented from coming in contact with the inner edge of the upper wall 13 or the bottom wall 14 of the connector cover 10. Furthermore, even if the electric wire 80 is in contact with the upper wall 13 or the bottom wall 14, the force exerted by the electric wire 80 on the upper wall 13 or the bottom wall 14 is smaller (compared with the case where the notch part 60 does not exist). Thus, as illustrated in FIG. 3, the electric wire 80 is not deformed into a corrugated shape. Further, even if the electric wire 80 is deformed into a corrugated shape, a swinging width (amplitude) of the electric wire 80 becomes small, the electric wire 80 to be routed can be flatten.

Figure 7:
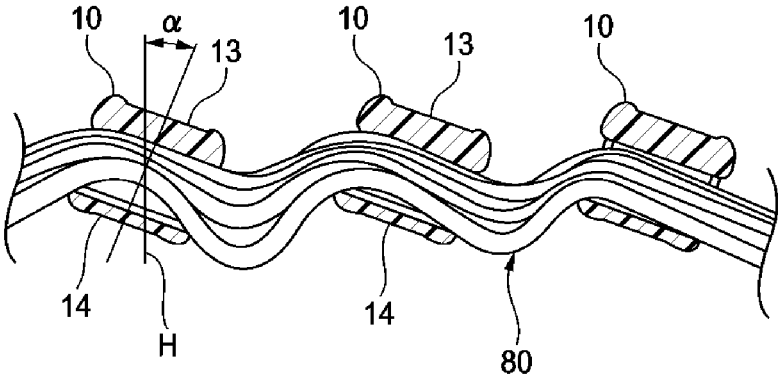
FIG. 7 is a sectional view of a connector cover in a case where the connector unit of the related art is rotated in the rolling direction.
Figure 8:
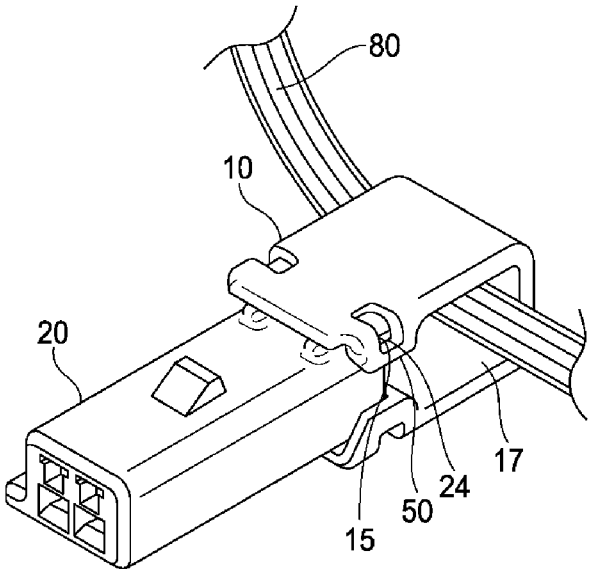
FIG. 8 is a perspective view of the connector unit of the related art.
Figure 9:
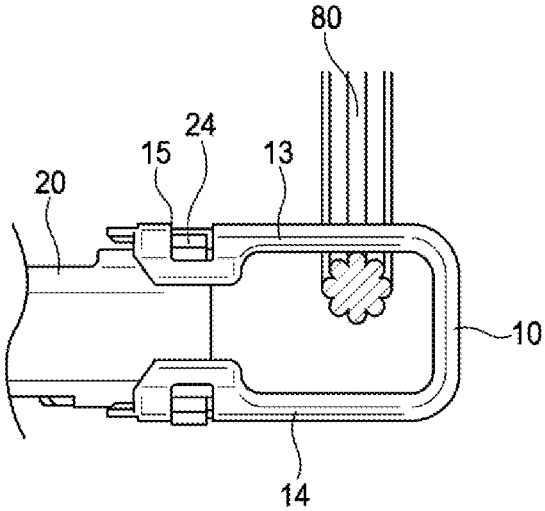
FIG. 9 is a side view of FIG. 8.
Figure 10:
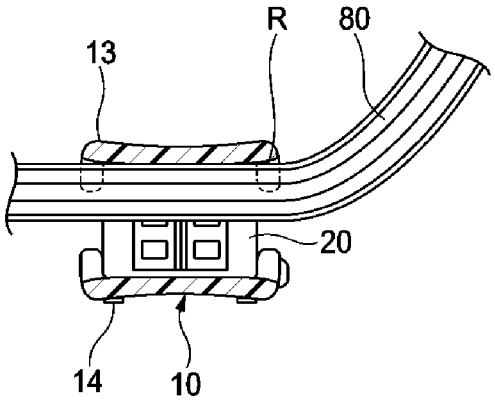
FIG. 10 is a sectional view of FIG. 8.

On the other hand, as illustrated in FIG. 7, in a case where the connector cover 10 having no notch part 60 is rotated by the angle α with respect to the vertical direction H, the inner edge of the upper wall 13 or the bottom wall 14 is pressed strongly against the electric wire 80 as the width dimension of the portion, which accommodates the electric wire 80, of the upper wall 13 and the bottom wall 14 is larger than the width dimension of the connector cover 10 of the connector unit 30. In comparison with the connector unit 30 having the configuration described above, it is apparent that the electric wire 80 in the connector cover of the related art is easily deformed into a corrugated shape.

According to the connector unit 30 having the above configuration, the electric wire 80 enters the notch part 60, so as to suppress that the electric wire 80 interferes with the inner edge of the upper wall 13 or the bottom wall 14 of the connector cover 10. Even if there is interference, the interference of the inner edge of the upper wall 13 or the bottom wall 14 with respect to the electric wire 80 is little. For this reason, the stress which the connector cover 10 receives from the electric wire 80 is lessened. As a result, the stress which concentrates on the engaging margin between the locking protrusion 24 and the locking hole 15 is lessened to prevent the deformation of the locking hole 15 or the locking protrusion 24.

When the effect of the invention is described, the description is given under such a viewpoint that suppresses that the electric wire 80 interferes with the inner edge of the upper wall 13 or the bottom wall 14 of the connector cover 10 having the above configuration. However, another effect may be described below. That is, in the connector cover 10, the notch part 60 is provided so that the rigidity of the connector cover 10 with respect to the twist is smaller as the width dimension of the portion, which accommodates the electric wire 80, of the upper wall 13 and the bottom wall 14 is smaller than the same dimension of the connector cover 10 in the related art. That is, the connector cover 10 is easily twisted. When it is considered that the stress transmitted by the twist and displacement to the engaging margin between the locking protrusion 24 and the locking hole 15 is larger as the rigidity with respect to the twist is larger, the connector cover 10 in which the rigidity is small with respect to the twist is formed so that the stress transmitted to the engaging margin between the locking protrusion 24 and the locking hole 15 is lessened. For this reason, it is possible to prevent the deformation of the locking hole 15 or the locking protrusion 24.

Incidentally, the stress which concentrates on the engaging margin of the locking protrusion 24 and the locking hole 15 is lessened more as the depth of the notch part 60 is larger, that it, as the width dimension of the portion, which accommodates the electric wire 80, of the upper wall 13 and the bottom wall 14 is smaller. However, on the other hand, from a viewpoint of a protecting member which protects the electric wire 80, it is also important that the connector cover 10 has strength in a certain degree. For this reason, the notch part 60 is preferably formed to have such a depth that does not hinder the strength required for the connector cover 10.

Incidentally, the technical scope of the invention is not limited to the above-described embodiment. The above-described embodiment may be modified or improved variously within the technical scope of the invention.

For example, in the embodiment described above, the notch parts 60 are formed in a total of four places on both sides of the upper wall 13 and the bottom wall 14. With such a configuration, although the connector cover 10 is turned upside down with respect to the female connector 20 to be assembled, it is suppressed that the electric wire 80 interferes with the inner edge of the upper wall 13 or the bottom wall 14 of the connector cover 10, which is advantageous. However, if the notch part 60 is formed in at least one place (for example, one place of P portion of FIG. 3) of four places provided this time, the interference from the electric wire 80 is lessened in the portion. Thus, an effect can be obtained which lessens the stress applied to a lock part.

Further, if the notch part is formed in Q portion on P diagonal line of FIG. 3 as well as the notch part is provided in one place of P portion, the interference is absorbed in the portion in which the interference of the electric wire 80 occurs most easily, which is more preferable.

Furthermore, the connector cover 10 including the notch part 60 is mounted to the female connector 20 in the embodiment described above. However, the connector cover 10 may be mounted to the male connector, or may be mounted to both the male connector and the female connector, as necessary.

Herein, the features of the embodiment of the connector unit according to the invention will be simply summarized as the following (1) to (3).

(1) A connector unit (30) comprising:

a connector (20); and a connector cover (10) mounted to one end of the connector, wherein the connector is capable of holding an electric wire (80) so as to extend from the one end and includes a locking part (24) at the one end, wherein the connector cover includes an upper wall (13) and a bottom wall (14) that sandwich the one end of the connector and that have a locked part (15) engaged with the locking part at a position corresponding to the locking part and side walls (16) connecting the upper wall and the bottom wall, and forms a hollow space (electric wire insertion port 17) surrounded by the connector, the upper wall, the bottom wall, and the side walls when being mounted to the connector, and wherein the connector cover includes notch parts (60) capable of receiving the electric wire at any one end of both ends of the upper wall corresponding to both opening ends of the hollow space and both ends of the bottom wall.

(2) The connector unit according to (1), wherein the notch parts (60) are formed at one position corresponding to one opening end of the hollow space out of the both ends of the upper wall (13) and one position corresponding to the other opening end of the hollow space (17) out of the both ends of the bottom wall (14).

(3) The connector unit according to (1), wherein the notch parts (60) are formed at the both ends of the upper wall (13) and the both ends of the bottom wall (14).

This application is based upon and claims the benefit of priority from Japanese Patent Application No. 2016-022909, filed Feb. 9, 2016, the entire contents of which are incorporated herein by reference.

INDUSTRIAL APPLICABILITY

According to the connector unit of the present invention, it is possible to prevent deformation of the engagement portion of the connector and the connector cover due to stress exerted by the electric wire on the connector cover. The present invention which exerts this effect is useful for a connector unit.

REFERENCE SIGNS LIST

10: Connector cover
11: Fitting part
13: Upper wall
14: Bottom wall
15: Locking hole (locked part)
16: Side wall
17: Electric wire insertion port (hollow space)
20: Female connector (connector)
24: Locking protrusion (locking part)
30: Connector unit
60: Notch part
80: Electric wire

The invention claimed is:

1. A connector unit comprising:

a connector; and a connector cover mounted to one end of the connector, wherein the connector is capable of holding an electric wire so as to extend from the one end and includes a locking part at the one end, wherein the connector cover includes an upper wall and a bottom wall and side wall connecting the upper wall and the bottom wall, and a portion of the upper wall and the bottom wall positioned on the one side of the connector is formed as a fitting part that sandwiches the one end of the connector, wherein the fitting part includes a horizontal plate part which is a wall surface erecting from the upper wall and the bottom wall to extend in a width direction of the connector cover, and both side plate parts which are wall surfaces which are provided in both end portions of the horizontal plate part to be separated to have almost the same inner width dimension as a width dimension of the one end of the connector, and a side of the fitting part which faces the connector is opened, and the fitting part has a locked part engaged with the locking part at a position corresponding to the locking part, wherein the connector cover forms a hollow space surrounded by the connector, the upper wall, the bottom wall, and the side wall between the horizontal plate part and the side wall when being mounted to the connector, and wherein the connector cover includes notch parts capable of receiving the electric wire at any one end of both ends of the upper wall and both ends of the bottom wall corresponding to both opening ends of the hollow space.

2. The connector unit according to claim 1, wherein wherein the notch parts are formed at one position corresponding to one opening end of the hollow space out of the both ends of the upper wall and one position corresponding to the other opening end of the hollow space out of the both ends of the bottom wall.

3. The connector unit according to claim 1, wherein the notch parts are formed at the both ends of the upper wall and the both ends of the bottom wall.

* * * * *